US005297701A

United States Patent [19]

Steijns et al.

[11] Patent Number: 5,297,701

[45] Date of Patent: Mar. 29, 1994

[54] ALL PLASTIC TRIGGER SPRAYER

[75] Inventors: Emile B. Steijns, Lierop; Wilhelmus J. J. Maas; Petrus L. W. Hurkmans, both of Someren, all of Netherlands

[73] Assignee: AFA Products, Inc., Forest City, N.C.

[21] Appl. No.: 840,759

[22] Filed: Feb. 24, 1992

[51] Int. Cl.[5] ..... B67D 5/42

[52] U.S. Cl. ..... 222/153; 222/340; 222/383

[58] Field of Search ..... 239/333; 222/153, 336, 222/340, 380, 383, 384, 385

[56] References Cited

U.S. PATENT DOCUMENTS

| | | | |
|---|---|---|---|
| Re. 33,235 | 6/1990 | Corsette | 239/333 |
| 3,973,700 | 8/1976 | Schmidt et al. | 222/380 X |
| 3,986,644 | 10/1976 | Grogan et al. | 222/207 |
| 4,155,487 | 5/1979 | Blake | 222/383 X |
| 4,191,313 | 3/1980 | Blake et al. | 222/383 X |
| 4,201,317 | 5/1980 | Aleff | 222/383 X |
| 4,225,061 | 9/1980 | Blake et al. | 222/383 X |
| 4,241,853 | 12/1980 | Pauls et al. | 222/207 |
| 4,352,443 | 10/1982 | Libit | 222/207 |
| 4,366,921 | 1/1983 | Kirk, Jr. | 222/153 |
| 4,593,607 | 6/1986 | Bennett | 222/383 X |
| 4,624,413 | 11/1986 | Corsette | 222/383 |
| 4,762,475 | 8/1988 | Fuchs | 222/384 X |
| 4,815,663 | 3/1989 | Tada | 239/333 |
| 4,890,773 | 1/1990 | Corsette | 222/380 |
| 4,915,263 | 4/1990 | Corba | 222/321 |
| 4,946,074 | 8/1990 | Grogan | 222/384 X |
| 4,971,227 | 11/1990 | Knickerbocker et al. | 222/380 X |

*Primary Examiner*—Andres Kashnikow
*Assistant Examiner*—Kenneth Bomberg
*Attorney, Agent, or Firm*—Thomas R. Vigil

[57] ABSTRACT

The trigger operated dispensing device for mounting to a container comprises: a body made of plastic material and having a pumping chamber therein. The pumping chamber has an open outer end and an inner back wall, a pumping mechanism associated with the body and includes a plastic piston situated in the pumping chamber and a plastic trigger coupled to the body. Non-metal biasing structure is situated between the trigger and the body for biasing the piston out of the pumping chamber. Non-metal fluid inlet structure and non-metal fluid outlet structure are associated with the pumping chamber and comprise first and second plastic flap valves in or adjacent the back wall. Also provided is non-metal structure for coupling the body to the container. The trigger operated dispensing device has only parts made of non-metal or synthetic material therein.

8 Claims, 12 Drawing Sheets

ALL PLASTIC TRIGGER SPRAYER

BACKGROUND OF THE INVENTION

1. Field of the Invention

The present invention relates to a trigger operated dispensing device for mounting to the top neck of a storage container. Although such devices, known as trigger sprayers, can be reused, often times they are disposed of. To facilitate disposal and/or recycling of the sprayer, the present invention relates to a non metallic all synthetic or all plastic trigger sprayer.

2. Description of the Related Art Including Information Disclosed Under 37 CFR § 1.97–1.99.

Heretofore, various trigger sprayers have been proposed.

A common construction for a trigger sprayer includes a body, a chamber or cylinder in the body, a piston and a metal spring in the cylinder and inlet and outlet valves, one of which is typically a metal ball valve . The spring biases the piston out of the cylinder, and a trigger is pivotally connected to the body and to the piston for urging the piston into the cylinder during a pumping stroke.

Other types of trigger operated sprayers also have been proposed and three examples of same are disclosed in the following three patents:

| U.S. Pat. No. | Patentee |
|---|---|
| 4,915,263 | Corba |
| 4,352,443 | Libit |
| 4,241,853 | Pauls et al. |
| 3,986,644 | Grogan et al |

In the Corba U.S. Pat. No. 4,915,263 a trigger sprayer having a plastic frame, including a trigger, an upper leg, a flexure, a lower leg, and a cap, together with a pumping device, a nozzle assembly and a delivery arm is disclosed. The pumping device is mounted in the cap of the frame and a tubular extension of the pumping device is inserted through an opening of the cap to be press-fitted to the delivery arm to create a connection between the container and the nozzle assembly mounted at the delivery arm.

The pumping device of the sprayer is made mainly out of plastic, but includes a coiled spring made of metal to provide a return force to the frame and the trigger handle. The frame, the nozzle and the delivery arm of the trigger sprayer are molded out of plastic material. As a part of the frame of the trigger sprayer the flexure is located between the upper leg and the lower leg of the frame and is also made of plastic.

The frame, including the trigger handle, the upper leg and lower leg, the flexure and the cap, is made of one piece of plastic. It is essential to have rotational freedom for the trigger handle, while being pressed down. Insufficient rotational freedom would cause significant damage, since the frame would be stretched above the Hook limit. The flexure provides this rotational freedom for the trigger handle. Thus, while pressing down the trigger handle, the plastic material of the frame, especially the flexure, is stressed and because of its plastic memory, it urges the frame, including the trigger handle, back to its home position. The returning force of the flexure is negligible and therefore the patentee suggests that the plastic flexure be replaced by a metal flexure, if necessary.

The major returning force of this trigger sprayer is provided by the metal spring of the pumping mechanism, and the main feature of the flexure is to provide rotational freedom to the trigger handle.

Additionally, a metal ferrule is used to seal the pumping device against the cap of the frame.

The Libit U.S. Pat. No. 4,352,443 discloses a pump dispenser including a sprayhead and a trigger-bulb pump wherein a trigger acts on a bulb to pump liquid into the bulb and then out of the bulb to a nozzle end. The trigger has a flexible flange member with contours that cooperate with the bulb and the sprayhead to form intake and outlet valves and an air breather valve. This patent does not describe the composition or material from which all the parts of the pump dispenser are made but the cross hatching in the drawings indicate that many of the components are made of plastic.

The Pauls et al. U.S. Pat. No. 4,781,311 discloses a multi-function dispenser adjustable to obtain a spray or stream of the material dispensed, either as a long duration discharge of the material or as intermittent discharges corresponding to actuation of a trigger actuator, or as a continuous discharge during actuation of the trigger, depending upon functional design variables. Structure is provided for storing an accumulated amount of material upon repeated operations of the trigger, for subsequent prolonged discharge of the material. The accumulating structure may be bypassed for intermittent discharge of the material as the trigger is operated, or the accumulating structure may function as a holding chamber whereby a continuous discharge of the material may be obtained while the trigger is being operated.

The multi-function dispenser is made mainly out of synthetic material, but incorporates also other materials, e.g. a rubber bladder or a metal valve actuator rod.

The Grogan et al U.S. patent discloses a dispensing pump wherein a trigger is pivotally mounted to a body by, what appears from the cross hatching in FIG'S. 4 and 5 of the drawings, a metal pin. The trigger acts against a resiliently deformable diaphragm which has an encircling flange that forms inlet and outlet valves. This patent does not describe the composition or material from which all the parts of the dispensing pump are made but the cross hatching in the drawings indicate that many of the components are made of plastic.

As will be described in greater detail hereinafter, the trigger sprayer of the present invention differs from the previously proposed trigger actuated sprayers by including in a piston and cylinder type trigger sprayer only synthetic or plastic parts, which enables the trigger sprayer to be recycled easily.

SUMMARY OF THE INVENTION

According to the present invention there is provided a trigger operated dispensing device for mounting to a container, the device comprising:

a body made of plastic material and having a pumping chamber therein;

the pumping chamber having an open outer end and an inner back wall;

a pumping mechanism associated with the body, and including a plastic piston situated in the pumping chamber and a plastic trigger coupled to the body;

non-metal biasing structure situated between the trigger and the body for biasing the piston out of the pumping chamber;

non-metal fluid inlet structure and non-metal fluid outlet structure associated with the pumping chamber and comprising first and second plastic flap valves in or adjacent the back wall;

non-metal structure for coupling the body to the container; and the trigger operated dispensing device having only parts made of non-metal or synthetic material therein.

DESCRIPTION OF THE PREFERRED EMBODIMENT(S)

Figure 1:
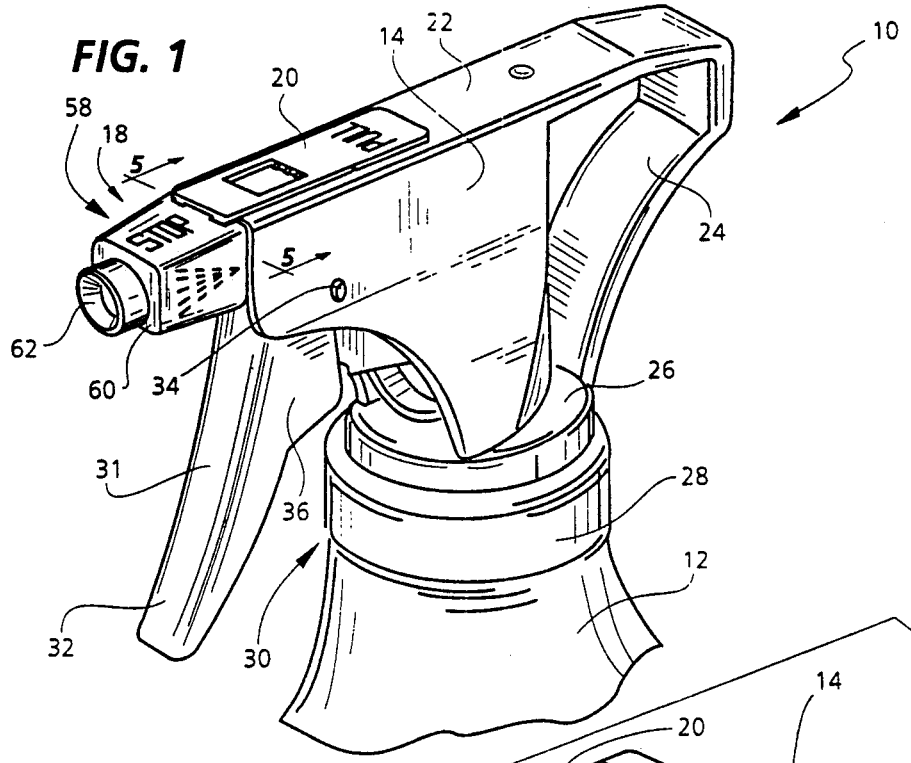
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
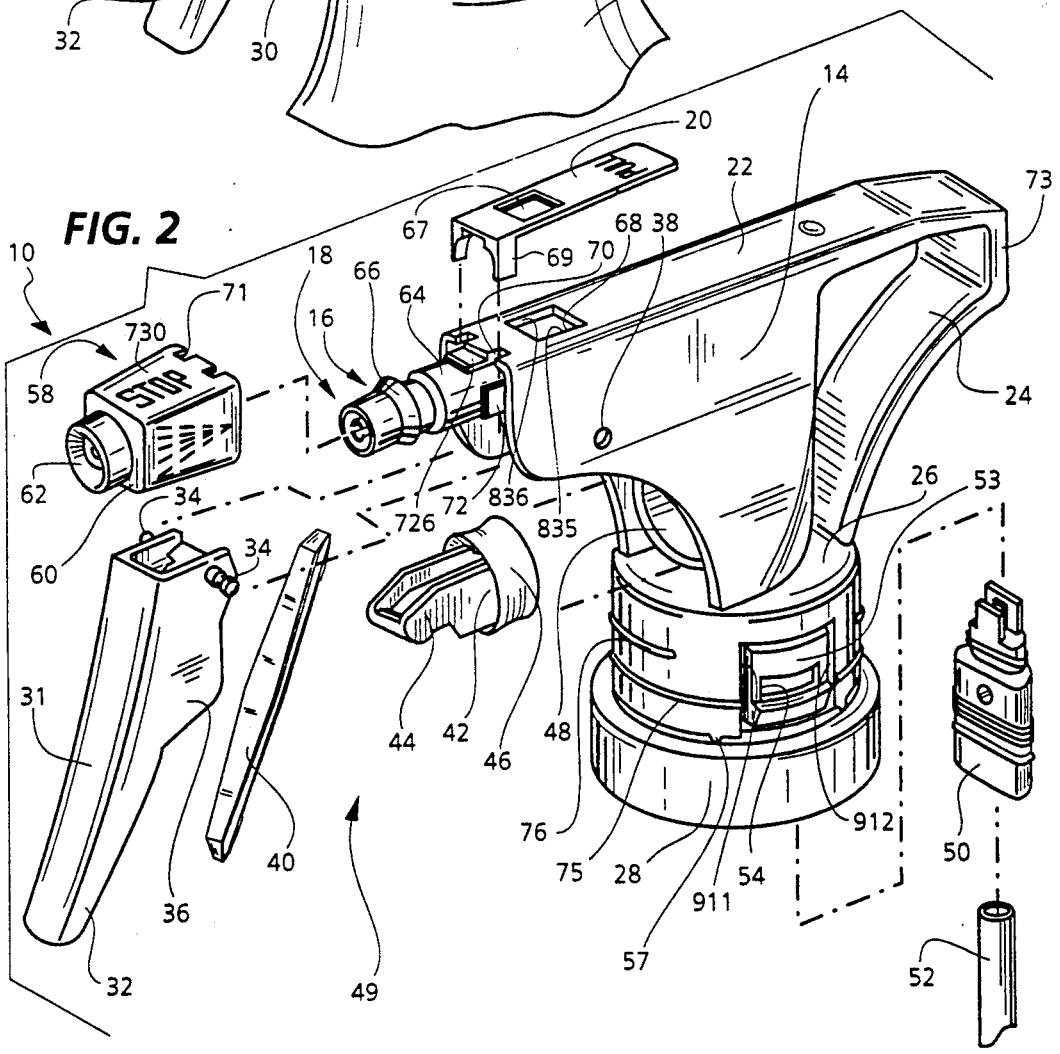
FIG. 2 is an exploded perspective view of the trigger sprayer shown in FIG. 1 and shows a locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, a groove within the locking ring 28 snap-fittingly mates with an annular rib 75 on the base 26. The upper position of the locking ring 28 is the pre-application-to-a-bottle position and the locking ring 28 is held in this position by the frictional engagement between the inner wall of the locking ring 28 and partially annular rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
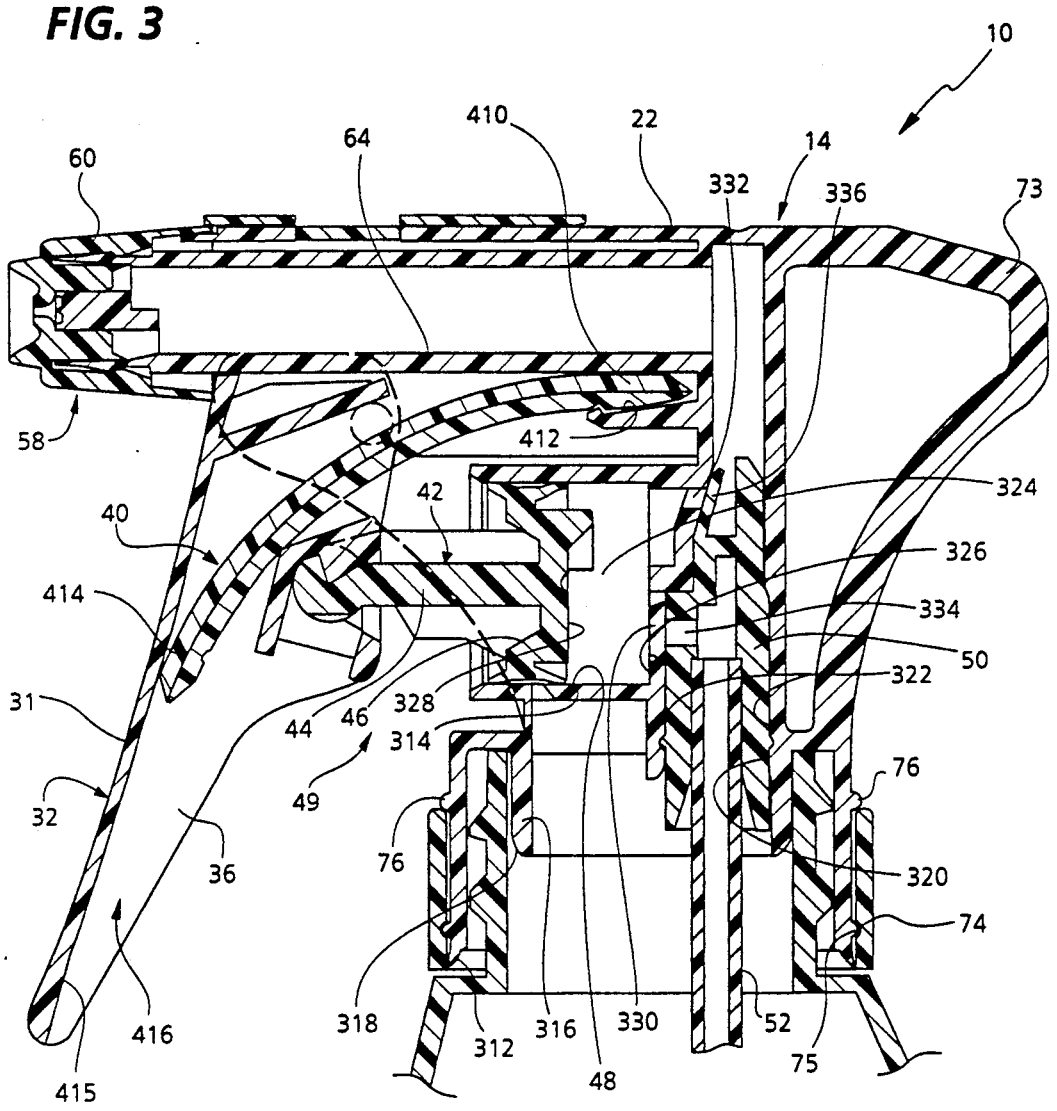
FIG. 3 is a vertical sectional view of the trigger sprayer in its at rest position where a spring between a trigger and the sprayer body biases the trigger and a piston rod coupled thereto to the most outward position.

As shown in FIG. 3, molded within the cylindrical base 26 to a top wall 314 of the cylindrical base 26 is a small diameter seal ring 316. The seal ring 316 is designed to seal against the inner diameter of the bottle neck 30. The seal ring 316 has a bevelled end 318 at its lower side to facilitate insertion of the bottle neck 30 into the base 26 and around the seal ring 316.

Within the inner area of seal ring 316 is an opening 320, having a shape according to the shape of the intake stem 50 which is generally oval in cross-section. The intake stem 50 is press-fitted into the opening 320 until ridges 322 on the intake stem 50 snap into mating mounting grooves on the inner surface of the wall of the opening 320. In this way, an air tight seal is provided. The diptube 52 is releasably fixed in the center of the intake stem 50. The length of the diptube 52 depends on the size of the bottle 12. However, it is recommended that the diptube 52 should extend to the bottom of the bottle 12 but shouldn't touch it.

The cylindrical opening 48 is located inside the body 14 of the trigger sprayer 10. The piston cylindrical end 46 fits tightly into the cylindrical opening 48 to create a pumping chamber 324 having a variable volume between a fixed back wall 326 of the cylindrical opening 48 and a rearwardly facing wall 328 of the piston cylindrical end 46. The fixed wall 326 of the pumping chamber 324 has an inlet flap valve 330 situated in the lower part thereof and an opening 332 in the upper part thereof. An orifice 334 through a wall of the intake stem 50 is located to mate or register with the inlet flap valve 330 and to establish an inlet passageway. The inlet passageway is provided by the hollow diptube 52, the intake stem 50 and the orifice 334.

The opening 332 is located to mate or register with an outlet flap valve 336 on the top side of intake stem 50. Inlet flap valve 330 and outlet flap valve 336 control the fluid flow into and out of pumping chamber 324.

The trigger 32 is pivotally mounted on the body 14 of the trigger sprayer 10 by inserting the two laterally extending pins 34 on the upper part of the trigger 32 into the two corresponding holes 38 in the body 14. The plastic spring assembly 40 has a flat tapered end 410 press-fitted into a recess 412 in the body 14 located underneath an inner end of the cylindrical portion 64 of the body 14. Another end 414 of the plastic spring assembly 40 is placed in a trough-like space 416 in the back side of the trigger 32 against a back wall 415. The plastic spring assembly 40 is bent and remains under stress to urge the trigger 32 always back into its home position.

Figure 4:
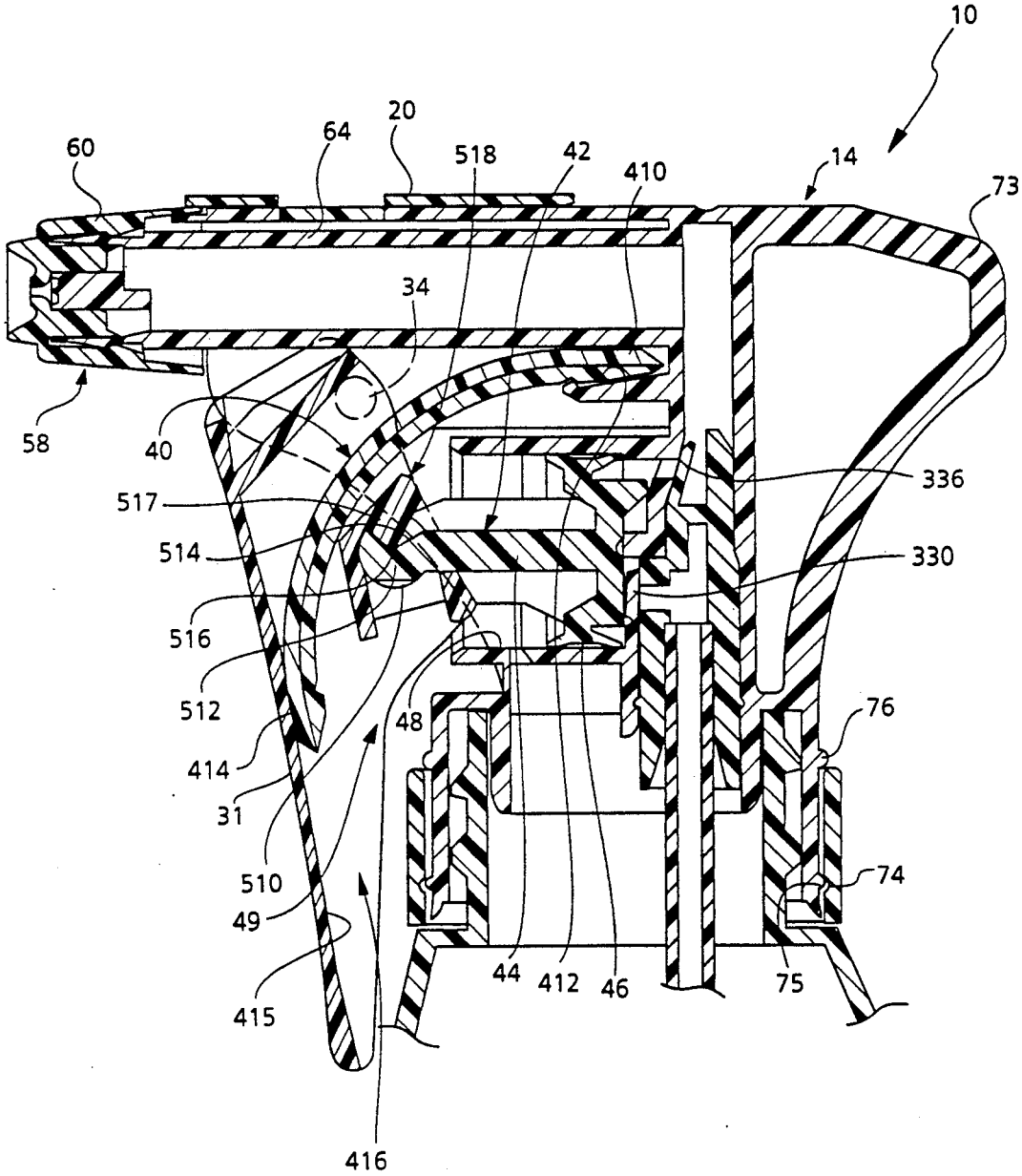
FIG. 4 is a vertical sectional view of the trigger sprayer similar to the view shown in FIG. 1 but showing the trigger fully depressed.
Figure 5:
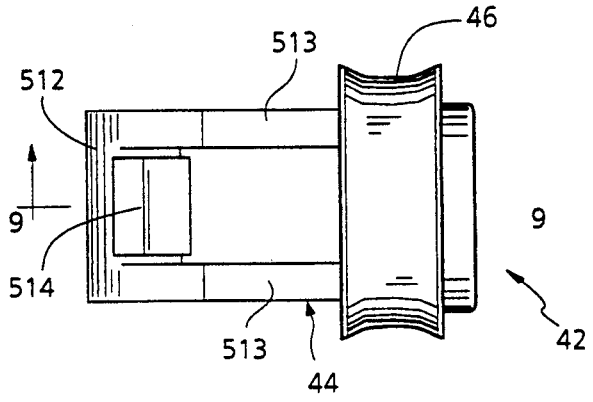
FIG. 5 is a top view of the piston shown in FIG. 3.
Figure 6:
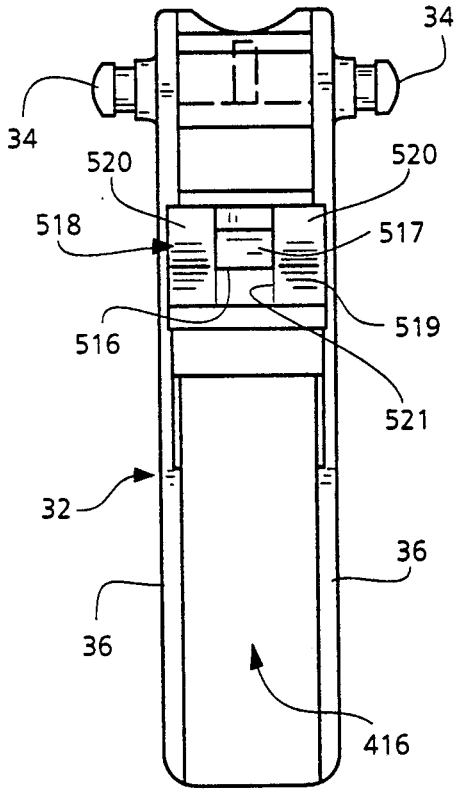
FIG. 6 is a vertical elevational view of the trigger shown in FIG. 3.

FIG. 4 shows the trigger sprayer 10 with the trigger 32 pressed in by the operator. The pressure in the pumping chamber 324 opens outlet flap valve 336 so that the fluid can leave pumping chamber 324. At the same time, the plastic spring assembly 40 is bent and stressed even more, but it is not stretched above its Hook limit, and the operator needs a maximum force to keep the trigger 32 pressed in.

After the operator stops pressing trigger 32, the plastic spring assembly 40 urges the trigger 32 together with piston 42 back into their home positions. While the piston 42 moves back, a vacuum arises inside the pumping chamber 324. This vacuum opens inlet flap valve 330 and sucks in fluid from the bottle 12.

When the fluid is sucked out of the bottle 12, and because the bottle 12 and the trigger sprayer 10 connection is air tight, a vacuum arises within the bottle 12. To avoid a vacuum within the bottle 12, a venting system in provided. The venting system includes a vent hole 344 in the top wall 314 of the cylindrical base 26. This part of the top wall 314 defines a wall area between the lower side of the cylindrical opening 48 inside body 14 of trigger sprayer 10 and a cylindrical cavity 346 within cylindrical base 26. When the trigger 32 is fully pressed in, vent hole 344 is opened and a fluid connection between the inside of the bottle 12 and the atmosphere is established so that air is able to get into the bottle 12. When the trigger 32 is not pressed in, e.g. when it is in its home position, the vent hole 344 is covered by the cylindrical end 46 of the piston 42 to close the vent hole 344 thereby preventing fluid from coming out of the bottle 12.

The pumping chamber 324 is designed so that, the "dead volume", i.e. the minimum volume of the pumping chamber 324, is very small, 1/20 to ¼ the full volume of pumping chamber 324. With a small dead volume, only a very little amount of the fluid or air is left in the pumping chamber 324, after the trigger 32 is fully pressed in. This construction minimizes the size of compressible air space inside the pumping chamber 324 and allows the trigger sprayer 10 to build higher compression against the flap valve 330 during the priming of the trigger sprayer 10. This minimized "dead volume" provides for quicker priming of the trigger sprayer 10 and higher vacuum and high compression during the intake and ejection strokes.

Another effect of the small "dead volume" is that the pumping chamber 324 is filled up with fluid very quickly therefore reducing the number of initial strokes required to prime the trigger sprayer 10.

As shown in FIGS. 3–6, an outer end 510 of the piston rod 44 has a transversely located cylinder 512. The cylinder 512 is located transversely to the longitudinal axis of the piston rod 44 between legs 513 and has an axially extending V in cross section slot 514 in the middle thereof for receiving a pivot edge 516 of a hook member 517 extending between the sides 36 of the trigger 32. The hook member 517 is part of a bearing formation 518 which is provided on the backside of trigger 32 between the sides 36 and which has an opening 519 (FIG. 6) through which the outer end 510 is received. The cylinder 512 engages in the bearing formation 518 of the trigger 32 and the sides of the V shaped slot 514 act as (or form) stops to limit the rotational freedom of the connected parts. The bearing formation 518, in combination with the V shaped slot 514, establish a movable trigger 32—piston 42 connection with limited, but sufficient, rotational freedom. This enables the piston 42 to be moved within the pumping chamber 324 while being pivotally connected to trigger 32 in a simple and efficient manner.

The bearing formation 518 includes two rounded bearing seating surfaces 520 adjacent the inner side of each side 36 of the trigger 32 and between one side 36 of the trigger 32 and the hook member 517 at the top of the opening 519 and between one side 36 and a slot 521 on the bottom of the opening 519. The cylindrical ends of the cylinder 512 seat and rotate on these bearing surfaces 520.

Figure 7:
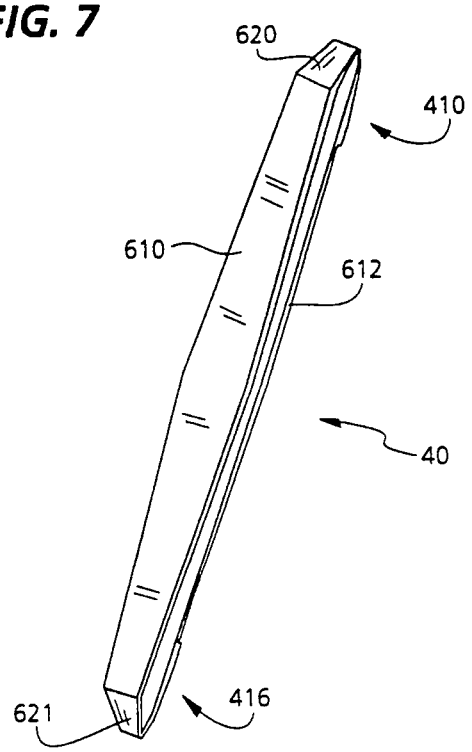
FIG. 7 is perspective view of a non-metal trigger sprayer spring assembly of the trigger sprayer shown in FIG. 1.
Figure 8:
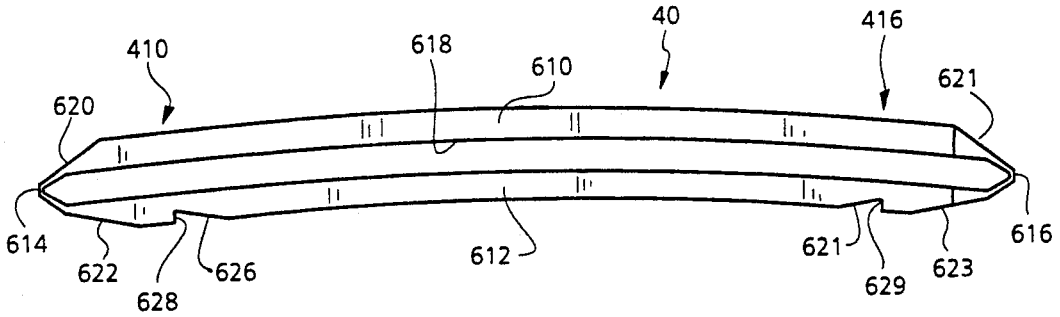
FIG. 8 is a side view of the spring assembly shown in FIG. 7.

Referring now to FIGS. 7 and 8, the spring assembly 40 includes two leaf springs 610 and 612 which are connected together at each end by a webbing 614 or 616. As shown in FIG. 8 the two springs 610, 612 are bowed slightly with to form an upper bowed spring 610 and a lower bowed spring 612. Each of these elongate springs 610, 612 are molded integral to each other and then a separation or split 618 between them is formed by a splitting process or cutting process. Further, as shown, each spring 610 and 612 is beveled at its ends as indicated by reference numerals 620 and 621 for spring 610 adjacent to the respective webbing 614 or 616. Likewise the lower elongate leaf spring 612 is beveled at 622 and 623 to the hinge or webbing 614 or 616 as shown.

Also, as shown in FIG. 7, the end portions of each spring 610, 612 are tapered toward the webbing 614 or 616 and each spring 610, 612, is wider in a middle portion indicated by reference numeral 625.

The lower elongate leaf spring 612 has a notch 626, 627 formed at each end thereof to define a shoulder 628 or 629.

The spring assembly 40 with the ends of the springs 610 and 612 formed in the manner described above define the mirror-image ends 410 and 416, each of which is configured to fit into the recess 412 with the shoulder 628 or 629 being adapted to engage or hook with a shoulder adjacent the lower outer end of the recess 412 as shown in FIGS. 3 and 4.

The leaf springs 610, 612 are made of glass fiber reinforced plastic material such as a mixture of polypropylene and polyamide (nylon) plus 30% by weight glass fibers.

Figure 9:
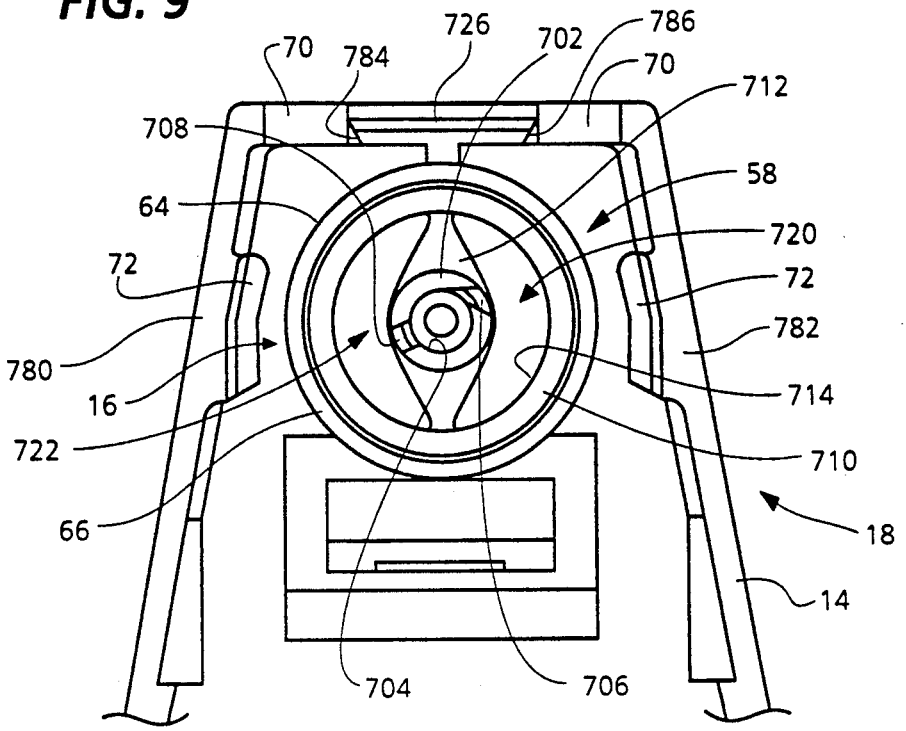
FIG. 9 is a front elevational view of the front end of the sprayer body and a nose bushing that extends from the front end of the body of the trigger sprayer shown in FIG. 2, but without a pull-away piece mounted at the end of the body.

Referring now to FIG. 9, which is a front elevational view of the nose bushing 16, it will be apparent that the nose bushing 16 includes a cylindrical extension 702 having an inner cylindrical cavity 704. The cylindrical extension has a first slot 706 through the cylindrical wall thereof which is a so-called tangential slot for directing liquid tangentially into the cylindrical cavity 704 and has a second, so-called radial, slot 708 for directing liquid radially into the cylindrical cavity 704.

The cylindrical extension 702 is small-in-diameter and is located coaxially with an outer cylinder 710 having a larger diameter. In the embodiment shown in FIG. 9, the smaller cylindrical extension 702 extends outwardly from a web 712 of material which fixes the cylindrical extension 702 in the position shown and defines between, an inner wall 714 of the outer cylinder 710, two waterways 720 and 722 which communicate liquid to be sprayed in a SPRAY or STREAM to the tangential slot 706 or to the radial slot 708.

Figure 10:
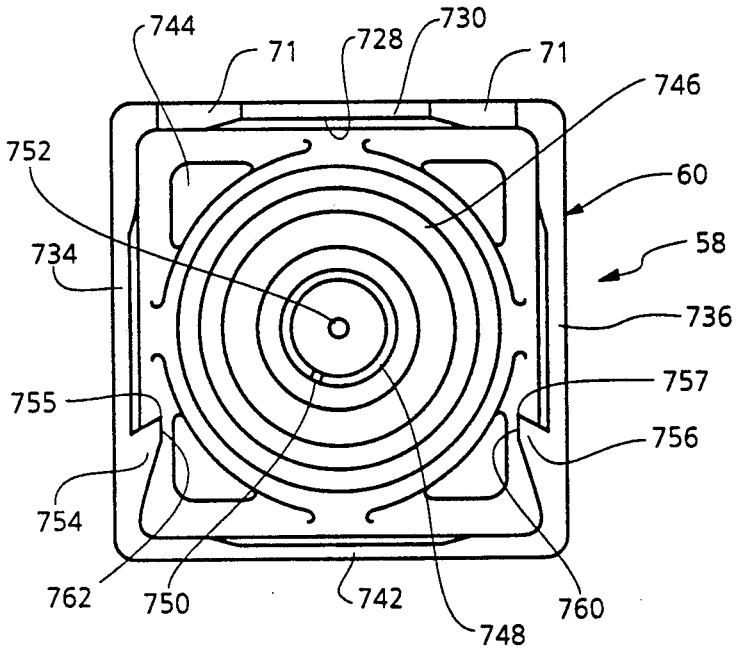
FIG. 10 is a back elevational view of the nozzle cap of a nozzle assembly shown in FIG. 2.
Figure 11:
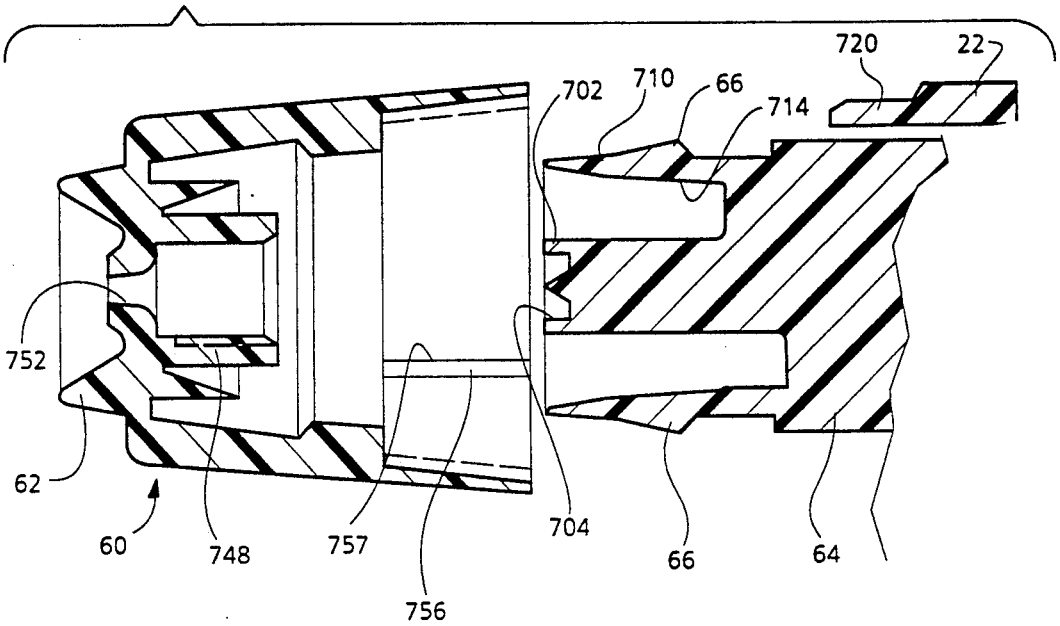
FIG. 11 is an exploded view in longitudinal vertical section of the nozzle cap and nose bushing shown of the nozzle assembly shown in FIG. 2 with portions broken away.
Figure 12:
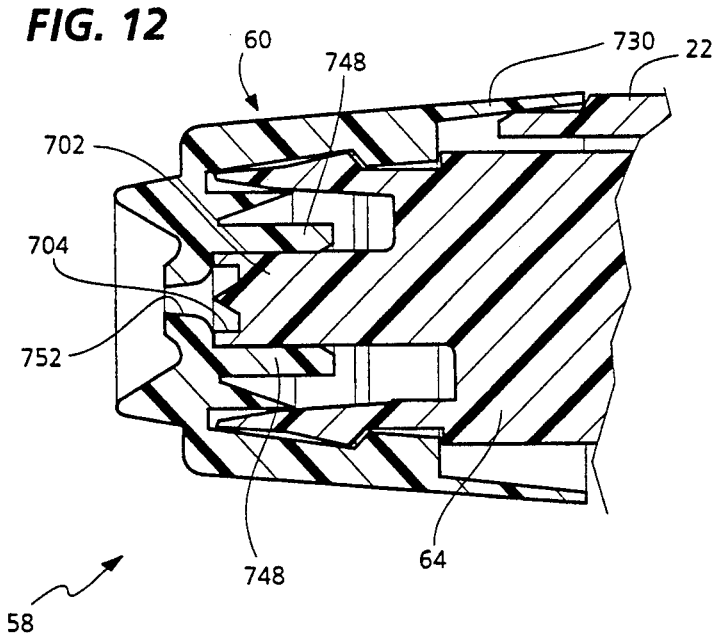
FIG. 12 is a longitudinal, generally vertically sectional view of the nozzle cap and nose bushing coupled together as shown in FIG. 1, with portions broken away.
Figure 13:
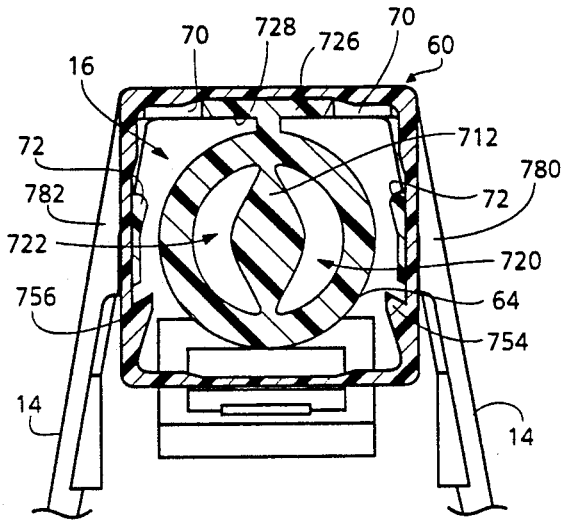
FIG. 13 is a vertical sectional view through the nozzle assembly shown in FIG. 1 after a pull-away piece is removed and is taken along line 13—13 of FIG. 1.
Figure 14:
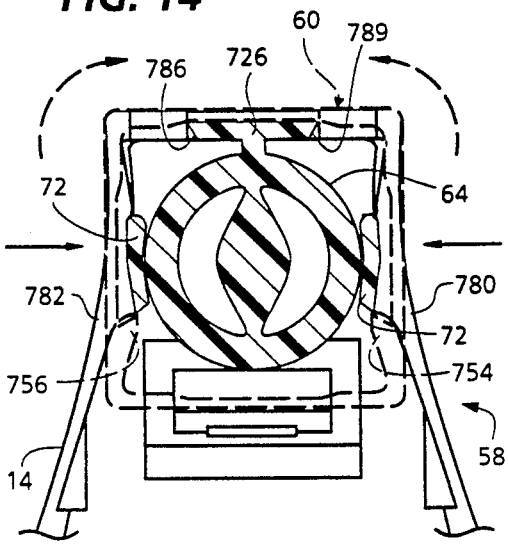
FIG. 14 is a vertical sectional view through the nozzle assembly, similar to the view shown in FIG. 13, but showing the side walls of the sprayer body squeezed in to move two legs or prongs extending from the body out of blocking position relative to two lugs on the inner wall of the nozzle cap.

Also, it will be apparent from FIG. 9 that the top of the body 14 between the slot 70 has a tab extension 726 which extends partially into a locating slot 728 in the back underside of a top side 730 wall of the nozzle cap 60 as shown in FIG. 10.

With reference to FIG. 10, it will be seen that the nozzle cap 60 has a generally square configuration with the top side wall 730 having STOP indicating indicia. A left side wall 734 has SPRAY indicating indicia thereon and a right side wall 738 which has STREAM indicating indicia.

Also, the nozzle cap 60 has a bottom wall 742, as shown in FIG. 10.

Within the envelope of the forward portions of the walls 730, 734, 736 and 742 and extending rearwardly from a front wall 744 of the nozzle cap 60 is a first outer cylinder 746 which is adapted to receive therein the outer cylinder 710 of the nose bushing 16. Then, also extending rearwardly from the front wall 744 within the outer cylinder 710 is a smaller-in-diameter cylinder 748 having a slot 750 extending radially therethrough which is adapted, upon selective rotation of the nozzle cap 60, to mate with either the tangential slot 706 or the radial slot 708 in the cylindrical extension 702. The smaller-in-diameter cylinder 748 is adapted to be received over the cylindrical extension 702.

In a manner which is conventional in the art, when the nozzle cap 60 is rotated counterclockwise 90° from the STOP position to the SPRAY position, liquid in the waterway 720 will pass through the slot 750 and through the mating slot 706 into the cylindrical cavity 704 and in a swirl forwardly to an outlet orifice 752 in the front wall 744 of the nozzle cap 60.

In a similar manner, when the nozzle cap 60 is rotated clockwise 90° from the STOP position to the STREAM position, the slot 750 in the wall of the cylinder 748 will mate or register with the radial slot 708 whereby liquid can flow from the waterway 722 through the slot 750 and through the slot 704 radially into the cylindrical cavity 704 and then axially forwardly and out of the orifice 752.

In this way, in a manner similar to previously proposed nozzle assemblies, liquid can be directed through the waterways 720 and 722 to selectively aligned, axially extending or radially extending, slots for communicating liquid in a swirl or in an axial path to the orifice 732 for effecting a desired discharge of liquid in either a conical spray or mist-like discharge or in a substantially axial STREAM type discharge.

Also, it will be understood that different formations can be utilized for effecting the mating of one or more tangential slots through a radial slot to a waterway or one or more radial slots to a radial or longitudinal slot and thence to a waterway, as disclosed in the Quinn et al U.S. Pat. No. 4,234,128 or the Dobbs et al U.S. Pat. No. 4,706,888, the disclosures of which are incorporated herein by reference.

Also in FIG. 10, there is illustrated a first formation 754 in the lower area on the inside of the side wall 734. This formation 754 defines a lug, boss or detent 754 that extends angularly upwardly and inwardly from the wall 734 inside the nozzle cap 60 to an edge or catch 755. In like manner, a lug, boss or detent 756 in the lower area of the wall 736 extends inwardly from the wall 736 inside the nozzle cap 60 to an edge or catch 757.

As will be described in greater detail hereinafter, the lugs 754 and 756 normally are positioned in the nozzle assembly 58 beneath the legs or prongs 72.

The blocking engagement of the legs or prongs 72 relative to the lugs or projections 754 and 756 normally prevents rotation of the nozzle cap 60 of the nozzle assembly 58 until the pull-away piece 20 is pulled away to remove the fork arms 69 from the locking position of each fork arm 69 between the cylindrical portion 64 and a leg or prong 72, and unless and until a user squeezes the side walls of the body 14 in the side wall areas 780 and 782 at the same time the user rotates the nozzle cap 60.

Figure 15:
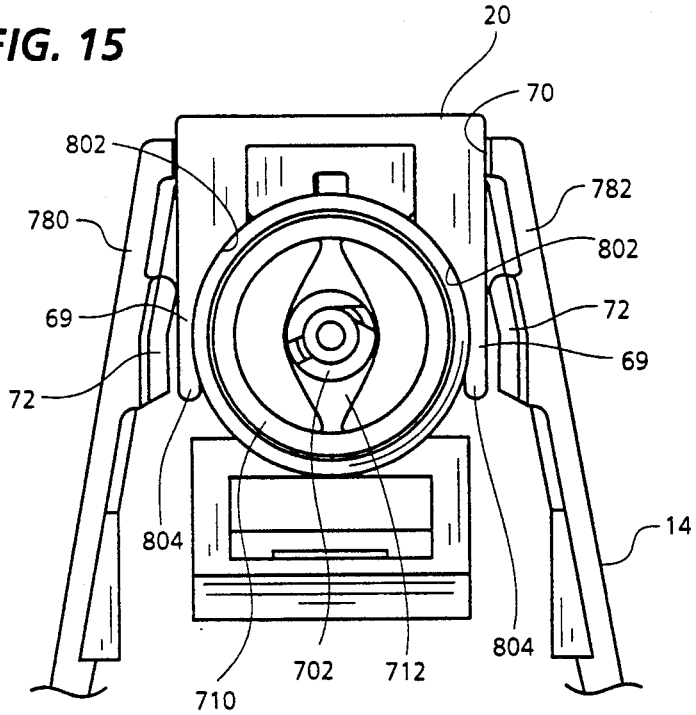
FIG. 15 is a front end elevational view of the sprayer body and the nose bushing that extends from the front end of the body of the trigger sprayer shown in FIG. 2, similar to FIG. 9, but with a pull-away piece mounted at the front end of the body.

With reference to FIGS. 2 and 15, it will be understood that the mounting block 67 of the pull-away piece 20 has a generally rectangular planar body 801 and is pressed downwardly after placement over the top portion 22 to snap-fittingly lock the mounting block 67 in the opening 68 in the top portion 22 of the body 14. At the same time, the fork arms 69, each having a curved inner surface 802, are received through the spaced apart slots or notches 70 in the top portion 22 at the front end thereof and through the slots or notches 71 in the rear edge of the top wall 730 of the nozzle cap 60, with the curved surfaces 802 being received around the cylindrical portion 64 of the body 14 and having lower ends 804 received between the cylindrical portion 64 and the spaced apart legs or prongs 72.

With the lower ends 804 of the fork arms 69 positioned in this manner, inward movement of the legs or prongs 72 when the wall areas 780 and 782 of the body 14 are squeezed is prevented.

As a result, if one tried to rotate the nozzle cap 60, such rotation is prevented, on the one hand by the fork arms 69 extending through the mating slots or notches 70 and 71 in the top wall portion 22 of the body 14 and the top wall 730 of the nozzle cap 60 and, on the other hand, by the blocking position of the fork arms 69 which prevent inward movement of the prongs 72 to enable the lugs 754 and 756 to be moved past the prongs 72 upon either clockwise or counterclockwise attempted rotation of the nozzle cap 60.

Figure 16:
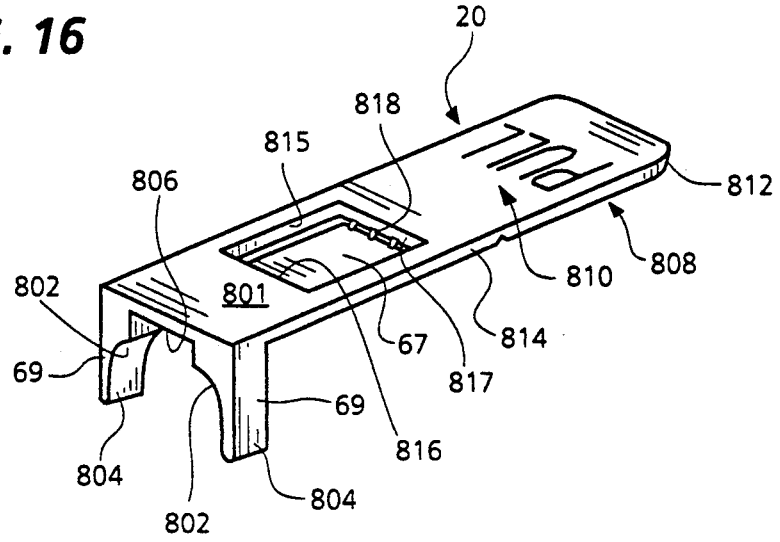
FIG. 16 is a perspective view of the pull-away piece mounted at the front end of the body and constructed according to the teachings of the present invention.

As best shown in FIG. 16, the pull-away piece 20 has at the front end thereof a rectangular recess 806 which is adapted to be received over the extension tab 726. The curved surfaces 802 extend downwardly and laterally on the inner side of the form arms 69 from the edges of the rectangular recess 806.

A top rear portion or pull tab 808 of the pull-away piece 20 has PULL indicia 810 thereon.

Figure 17:
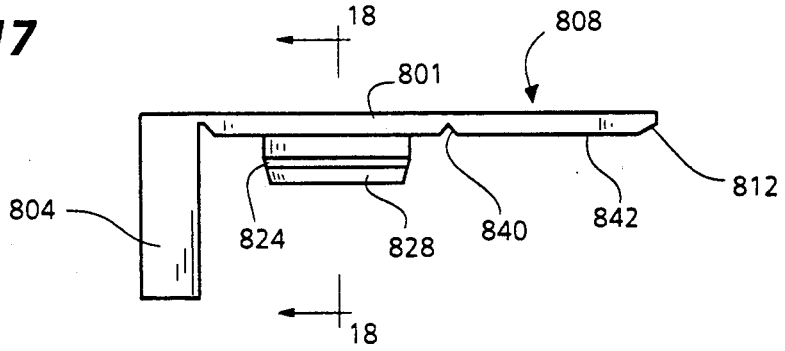
FIG. 17 is a side elevational view of the pull-away piece shown in FIG. 16.

Further, to facilitate pulling of the pull-away piece 20, the rear underside of the pull tab 808 is beveled upwardly at 812 as shown in FIGS. 17.

Figure 18:
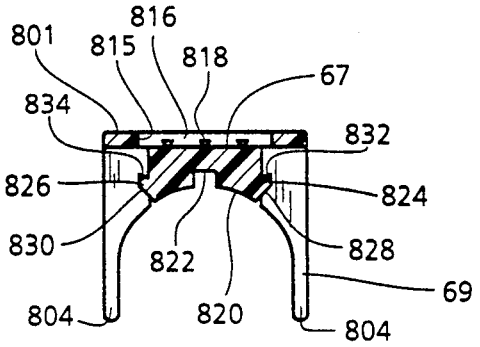
FIG. 18 is a vertical sectional back view of the pull-away piece and is taken along line 18—18 of FIG. 17.

The mounting block 67 is positioned below the planar body 801 of the pull-away piece 20 beneath a recess 815 in the planar body 801 and is connected to front and back edges 816, 817 of this recess 815 by three webs or fillets 818, as best shown in FIG. 18.

The mounting block 67 has a curved lower surface 820 with a central longitudinally extending slot 822 separating the mounting block 67 into left and right prong portions 824 and 826. Each prong portion 824 and 826 has an inclined surface 828, 830 which inclines upwardly and laterally outwardly from the curved surface 820 to a shoulder 832, 834, as best shown in FIG. 18.

It will be understood that when the mounting block 67 is pushed downardly through the opening 68, the inclined surfaces 828 and 830 engage the sides of the opening 68 and the slot 822 allows the prong portions 824 and 826 to be deflected inwardly until the shoulders 832 and 834 are moved past lower side edges 835 and 836 of the opening 68 and snap into a locking position beneath the top wall portion 22 of the body 14 adjacent the side edges 835, 836 of the opening 68. The curved surface 820 will then rest upon the upper surface of the cylindrical portion 64 perhaps with a slight interference fit between the cylindrical portion 64 and the underside of the top wall surface 22.

As shown in FIG. 17, the planar bottom portion 801 has a transverse groove 840 in a lower surface 842 thereof to facilitate bending of the pull tab 808.

The pull-away piece 20 provides tamper evident structure for the nozzle assembly 58. In this respect, if the pull-away piece 20 is broken or missing, that is evidence that the nozzle assembly of the trigger sprayer has been tampered with.

In use, a user will grip the pull tab 808 at the rear end of the break away piece 20 and pull upwardly, with the bevel 812 facilitating gripping of the pull tab 808 and the transverse groove 840 facilitating bending of the pull tab 808 upwardly. As the pull tab 808 is pulled upwardly, first the webs or fillets 818 at the back edge 817 of the recess 815 are broken followed by breaking of the webs or fillets 818 at the front edge 816 of the recess 815. After the webs or fillets 818 are broken, the pull-away piece 20 can be easily removed from the sprayer body to remove the fork arms 69 from the mating slots or notches 71 and 72 and to remove the lower ends 804 of the fork arms 69 from a blocking position between the cylindrical portion 64 and the legs or prongs 72 to enable a user to use the trigger sprayer 10.

Figure 19:
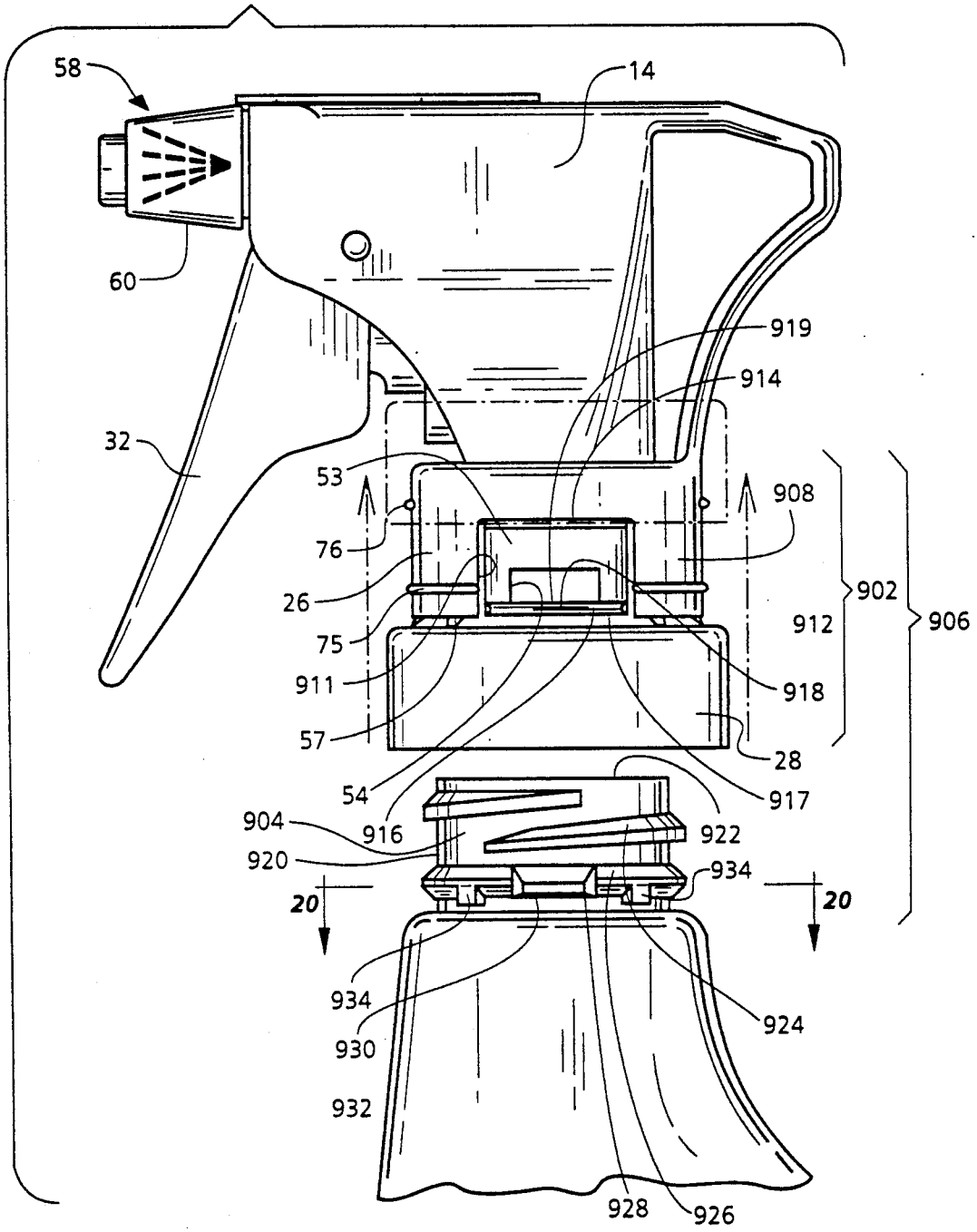
FIG. 19 is an exploded side elevational view of the trigger sprayer bottle cap/bottle neck assembly of the present invention including a quick-locking bottle cap assembly of the present invention positioned over a mating bottle neck.
Figure 20:
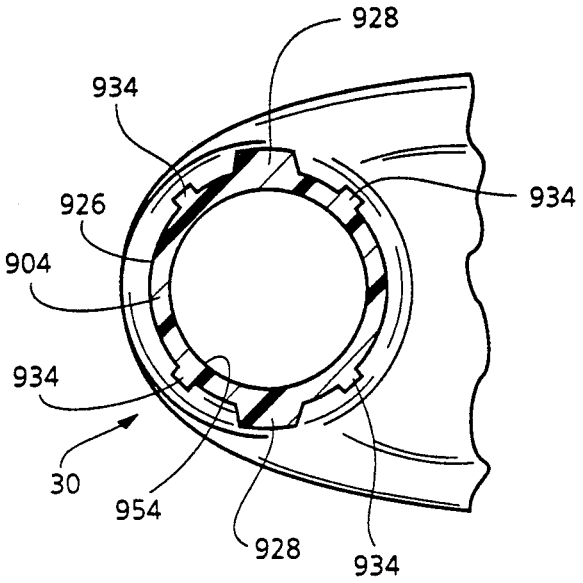
FIG. 20 is a horizontal sectional view through the bottle neck and is taken along line 20—20 of FIG. 19.

Referring now to FIG. 19, there is illustrated therein the locking ring 28 before it is detached from the cylindrical base 26 by breaking the fillets 57. The cylindrical base 26 and the locking ring 28 form a bottle cap assembly 902 constructed according to the teachings of the present invention which together with a tubular portion 904 of the bottle neck 30 form a bottle cap/bottle neck assembly 906.

The locking ring 28 is broken away during the molding process and moved upwardly as indicated by the arrows and as shown in phantom frictionally engaging the rib segments 76. In this position, the cylindrical base 26 and the locking ring 28 are ready for being pressed downwardly upon the bottle neck 904 and the locking ring 28 temporarily is held in place by its frictional engagement with the rib segments 76.

As shown, the cylindrical base 26 has a cylindrical wall portion 908 having a pair of spaced apart upwardly extending slots 911 and 912 formed therein on each side of the sprayer body 14 so as to define therebetween two of the locking tabs 53. At the upper end of each locking tab 53 is a line area of reduced thickness 914 to provide a hinge 914 whereby each locking tab 53 can be flexed inwardly or outwardly relative to the cylindrical wall 908 of the cylindrical base 26.

The lug receiving opening 54 in each tab 53 is generally rectangular as shown. There is provided beneath the opening 54 on each locking tab 53 an outwardly extending flange 916 having an inclined lower surface 917 which inclines upwardly and outwardly from the bottom of the tab 53 to an outer surface 918. A top surface or shoulder 919 extends horizontally radially outwardly from the tab 53 to the outer surface 918 and radially outwardly from the tab 53 to the outer surface 918 and faces upwardly.

The bottle neck 904 is generally tubular in shape and has an outer cylindrical surface 920 and an annular top edge 922. A conventional thread 924 is provided on the cylindrical outer surface 920.

Beneath the thread 924 on the outer cylindrical surface 920 is an annular rib 926 having, on diametrically opposite sides of the outer cylindrical surface 920, locking lugs 928 which are generally rectangular in shape with a lower horizontally extending shoulder 930 and an upper inclined surface 932 which inclines downwardly from the outer cylindrical surface 920. Each of the lugs 928 is generally rectangular in shape and located circumferentially to the side of and on each side of each lug 928 is a stop post 934 which serve to locate the locking tabs 53 when they are pushed down over the locking lugs 928.

Figure 21:
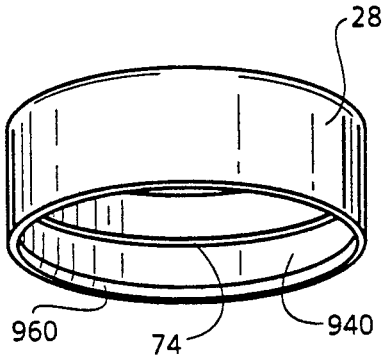
FIG. 21 is a perspective view of the locking ring.

As shown in FIG. 21, the locking ring 28 has the annular groove 74 formed on the inner cylindrical surface 940 thereof. The groove 74 is adapted to snap fittingly receive the annular rib 75.

Figure 22:
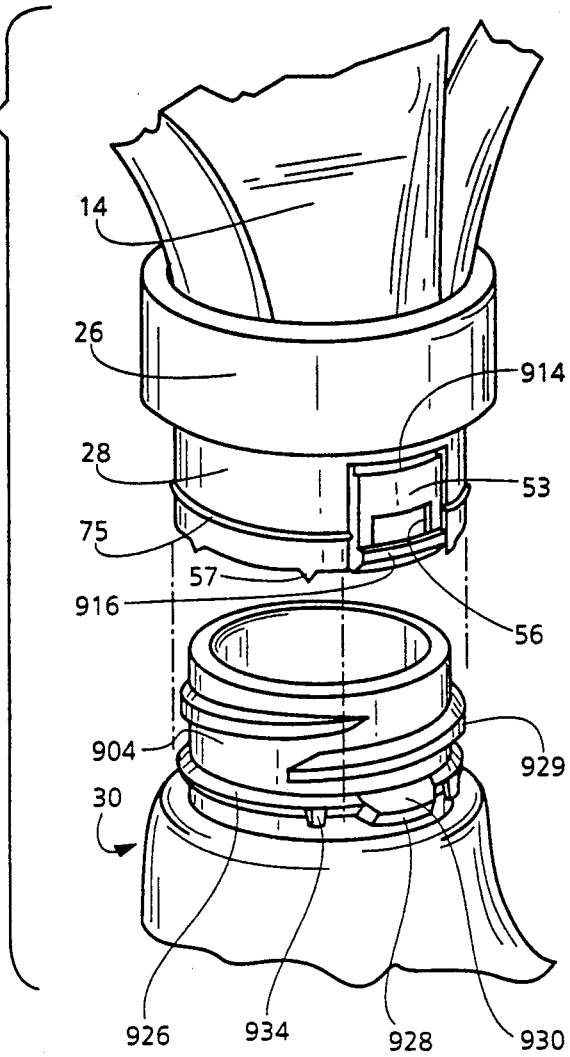
FIG. 22 is a fragmentary rear elevational view of the bottle cap/bottle neck assembly with portions broken away to show the bottle cap/bottle neck assembly in vertical section.
Figure 23:
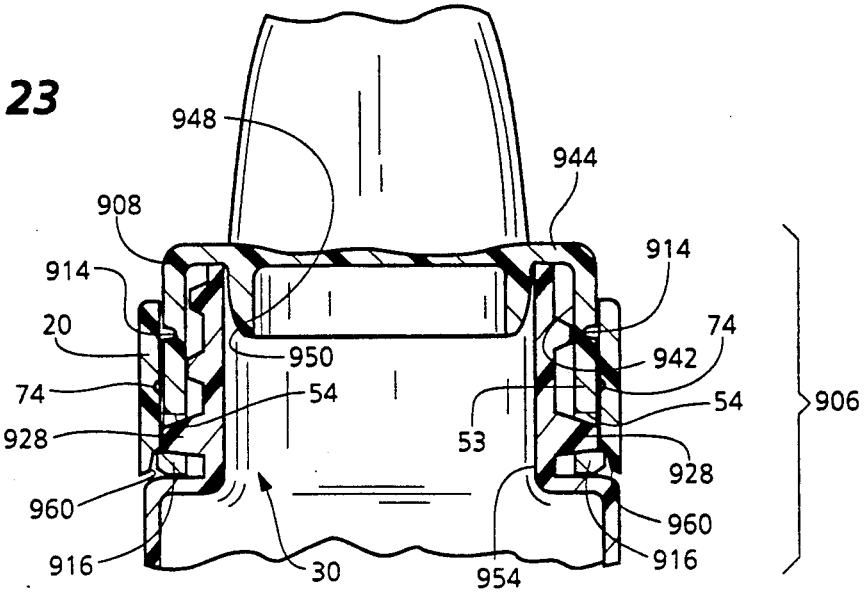
FIG. 23 is a transverse vertical sectional view through the trigger sprayer bottle cap/bottle neck assembly.

As shown in FIG. 22, the cylindrical wall 908 of the base 26 has an inner cylindrical surface 942 which is received over the tubular portion 904 and which is typically unthreaded, as shown.

The cylindrical wall 908 extends to a top wall 944 of the cylindrical base 26. Inwardly of the cylindrical surface 942 is a sealing ring 948 which has a lower outer beveled edge 950 and which extends downwardly from the top wall 944 and is adapted to be received frictionally within tubular inner surface 954 of the tubular portion 904 of the bottle neck 30, as shown in FIG. 22.

Also as shown in FIG. 22, the locking ring 28 has a lower beveled or recessed inner surface 960 which is received over any protruding portion of the flanges 916 when the locking ring 28 is positioned over the tabs 53.

As shown in FIG. 22, the cylindrical base 26 with the locking ring 28 held in a raised position (FIG. 19) is pressed downwardly over the tubular portion 904 of the bottle neck 30 to press the sealing ring 948 within the inner surface 954 and at the same time push the tabs 53 downwardly over the inclined surface 932 of each of the locking lugs 928 until each locking lug 928 snaps into one of the openings 54 in one of the locking tabs 53. Then, the locking ring 28 is moved downwardly with the inner surface 940 thereof frictionally engaging the ribs 76 until the rib 75 is snap fittingly received in the annular groove 74 where the locking ring 28 is detachably locked in place against vertical movement of the locking ring 28 with the rib segments 76 being located adjacent the upper annular edge of the locking ring 28. This locking relationship is shown in FIG. 22.

The bottle neck/bottle cap assembly 906 shown in FIG. 22 and 10 provides a quick, push on, coupling of the bottle cap assembly 902 onto the bottle neck 30 and the engagement of the locking lugs 928 with the openings 54 in the locking tabs 53 prevents vertical movement of the cylindrical base 26 off of the bottle neck 30, locates the trigger sprayer 10 in a desired relationship with the bottle 12 and prevents relative rotational movement between the cylindrical base 26 and the bottle neck 30.

We claim:

1. A trigger operated dispensing device for mounting to a container, said device comprising:

a body made of plastic material and having a pumping chamber therein;

said pumping chamber having an open outer end and an inner back wall;

a pumping mechanism associated with said body and including a plastic piston situated in said pumping chamber and a plastic trigger coupled to said body,;

non-metal biasing means situated between said trigger and a position on said body located rearwardly of said trigger exterior of said pumping chamber for biasing said piston out of said pumping chamber;

non-metal fluid inlet means and non-metal fluid outlet means associated with said pumping chamber and at least one of said inlet means and outlet means being a plastic flap valve;

non-metal means for coupling said body to the container; and said trigger operated dispensing device having only parts made of non-metal material therein.

2. The dispensing device of claim 1 wherein said biasing means includes a spring made of glass fiber reinforced plastic.

3. The dispensing device of claim 1 wherein said biasing means is a spring assembly including two, elongate plastic leaf springs.

4. The dispensing device of claim 1 wherein said fluid outlet means include a nozzle made of plastic material.

5. The dispensing device of claim 4 further comprising means for tamper proofing the dispensing device.

6. The dispensing device of claim 5 wherein the means for tamper proofing the dispensing device is a plastic pull away piece fixed to said body and engaging said nozzle.

7. The dispensing device of claim 1 wherein said coupling means include means for simultaneously connecting said device to and positioning said device relative to a container.

8. The dispensing device of claim 1 wherein said coupling means include plastic locking tabs on the bottom of said body and a plastic locking ring for holding said locking tabs in coupling engagement with engaging means on a container neck.

* * * * *